US012605591B2

(12) United States Patent
Mattox

(10) Patent No.: US 12,605,591 B2
(45) Date of Patent: Apr. 21, 2026

(54) CONTROLLED SQUAT STRENGTH-TRAINING MACHINE

(71) Applicant: Ernest Michael Mattox, Holt, MO (US)

(72) Inventor: Ernest Michael Mattox, Holt, MO (US)

( * ) Notice: Subject to any disclaimer, the term of this patent is extended or adjusted under 35 U.S.C. 154(b) by 0 days.

(21) Appl. No.: 19/179,084

(22) Filed: Apr. 15, 2025

(65) Prior Publication Data

US 2025/0242199 A1 Jul. 31, 2025

Related U.S. Application Data

(63) Continuation of application No. 18/529,356, filed on Dec. 5, 2023, now abandoned, which is a continuation of application No. 17/973,308, filed on Oct. 25, 2022, now Pat. No. 11,833,390.

(60) Provisional application No. 63/273,004, filed on Oct. 28, 2021.

(51) Int. Cl.

| | |
|---|---|
| ***A63B 23/04*** | (2006.01) |
| ***A63B 21/00*** | (2006.01) |
| ***A63B 21/002*** | (2006.01) |
| ***A63B 21/04*** | (2006.01) |
| ***A63B 21/055*** | (2006.01) |

(52) U.S. Cl.

CPC ..... *A63B 23/04* (2013.01); *A63B 21/002* (2013.01); *A63B 21/0407* (2013.01); *A63B 21/0557* (2013.01); *A63B 21/154* (2013.01); *A63B 21/4015* (2015.10); *A63B 21/4035* (2015.10); *A63B 21/4039* (2015.10); *A63B 2023/0411* (2013.01); *A63B 2230/01* (2013.01)

(58) Field of Classification Search

CPC ... A63B 23/04; A63B 21/002; A63B 21/0407; A63B 21/0557; A63B 21/154; A63B 21/4015; A63B 21/4035; A63B 21/4039; A63B 2023/0411; A63B 2230/01

See application file for complete search history.

(56) References Cited

U.S. PATENT DOCUMENTS

| | | | | |
|---|---|---|---|---|
| 3,682,475 A * | 8/1972 | Walker | A63B 23/0211 482/145 |
| 3,787,048 A * | 1/1974 | Bock | A63B 21/00047 482/145 |
| 3,850,430 A * | 11/1974 | Hamilton | A63B 21/0615 482/97 |
| 5,637,063 A | 6/1997 | Fuller, Sr. | |
| 6,692,418 B2 * | 2/2004 | Shahan | A63B 23/0233 482/148 |
| 7,004,894 B1 * | 2/2006 | Trotter | A63B 23/0211 482/142 |
| 7,029,426 B1 | 4/2006 | Fuller, Sr. | |

(Continued)

FOREIGN PATENT DOCUMENTS

KR 102294801 B1 * 8/2021

*Primary Examiner* — Andrew S Lo
(74) *Attorney, Agent, or Firm* — AVEK IP, LLC

(57) ABSTRACT

A controlled squat strength-training machine includes a frame with a base mounting forward, intermediate, and rear uprights. The intermediate upright is pivotally connected to the base and is configured for limited rotation fore-and-aft. Knee pads are provided for restraining of users' knees. Users can adjust the resistance of the machine and thereby vary the exercises performed thereon.

19 Claims, 9 Drawing Sheets

(56) References Cited

U.S. PATENT DOCUMENTS

| | | | | |
|---|---|---|---|---|
| 7,470,221 | B1 | 12/2008 | Ramos | |
| 7,678,033 | B2 * | 3/2010 | Tyree | A63B 21/4035 482/142 |
| 8,096,930 | B1 * | 1/2012 | Leon | A63B 69/0062 482/130 |
| 8,147,389 | B1 | 4/2012 | Hoole | |
| 8,801,640 | B2 * | 8/2014 | Sevy | A63B 23/03508 601/24 |
| 9,119,984 | B2 * | 9/2015 | Littell | A63B 69/0062 |
| 9,370,688 | B1 * | 6/2016 | Pannozzo | A63B 21/00047 |
| 9,446,284 | B2 * | 9/2016 | Sela | A63B 23/0355 |
| 9,630,055 | B2 * | 4/2017 | Runyan | A63B 21/00047 |
| 9,878,203 | B1 * | 1/2018 | Guarnaccia | A63B 21/00047 |
| 10,220,233 | B2 | 3/2019 | Schmidt et al. | |
| 10,456,620 | B1 * | 10/2019 | Duenas | A63B 21/0085 |
| 10,792,532 | B1 | 10/2020 | Hall et al. | |
| 11,077,338 | B1 * | 8/2021 | Levin | A63B 21/4034 |
| 11,235,194 | B2 | 2/2022 | Parker | |
| 11,673,020 | B1 * | 6/2023 | Graack | A63B 21/0442 482/130 |
| 12,076,608 | B2 * | 9/2024 | Peterson | A63B 23/0494 |
| 2007/0197353 | A1 | 8/2007 | Hundley | |
| 2008/0058172 | A1 * | 3/2008 | Tyree | A63B 23/0494 482/92 |
| 2011/0143890 | A1 * | 6/2011 | Reyes | A63B 21/154 482/99 |
| 2017/0203149 | A1 | 7/2017 | D'Amico | |
| 2018/0311529 | A1 * | 11/2018 | Sadikaj | A63B 69/0062 |
| 2020/0038704 | A1 | 2/2020 | Adams | |
| 2020/0094099 | A1 | 3/2020 | Kelly | |

* cited by examiner

CONTROLLED SQUAT STRENGTH-TRAINING MACHINE

CROSS-REFERENCE TO RELATED APPLICATION

This application is a Continuation of and claims priority in U.S. Non-Provisional patent application Ser. No. 18/529,356, filed Dec. 5, 2023, which is a Continuation of and claims priority in U.S. Non-Provisional patent application Ser. No. 17/973,308, filed Oct. 25, 2022, which claims priority in U.S. Provisional Patent Application No. 63/273,004, filed Oct. 28, 2021, all of which are incorporated herein by reference.

BACKGROUND OF THE INVENTION

1. Field of the Invention

The present invention relates generally to exercise equipment, and in particular to a strength-training machine for performing squats with variable resistance through a controlled range-of-movement (ROM) for dynamic positioning.

2. Description of the Related Art

Physical training (PT) exercises can be performed with free weights, such as barbells, dumbbells, etc. Moreover, individuals can strength-train using their own body weight in exercises such as push-ups, pull-ups, etc. Exercise machines are available for performing various resistance training exercises within controlled ranges-of-movement (ROMs) with adjustable resistance. However, previously, there has not been available a squat strength-training machine with the advantages and features of the present invention, including stabilizing a user's knee joints throughout the squat (ROM) exercise.

Squat exercises are performed by individuals raising and lowering themselves between standing and squatting positions. Squats strengthen several muscle groups, including quadriceps in the legs and erectors in the back. Greater strength can be achieved by performing squats with free weights, such as barbells resting on the shoulders and by participants holding dumbbells. By using free weights, the strength-training benefits are increased. However, participants using unrestrained free weights are susceptible to injuries, particularly to the knees. Risks of injuring or "blowing out" knees increase as individuals perform squats with greater weights. Such injuries can range from minor strains of the muscles and ligaments to tears and separations. Extensive injuries can necessitate medical treatment and, in severe cases, surgical repair of damaged muscles and ligaments.

Heavy lifts, including squats, are often done in the presence of another individual, i.e., a "spotter." Spotters can catch a barbell in the event an individual is unable to complete the exercise due to excessive weight, fatigue, muscle cramping, etc. Alternatively, squat cages and similar equipment are available for controlling ranges of movement and reducing injury risks to users.

Resistance training equipment using springs and elasticized bands as resistance elements are also available. Variable resistance can be achieved by using springs and bands with different expansion-contraction characteristics, and by using multiple resistance elements.

Previously, there has not been available a dynamic-positioning, knee-stabilizing, motion-limiting, squat-training machine with the advantages and features of the present invention.

SUMMARY OF THE INVENTION

The present invention includes a frame configured for placement on a flat surface. The individual participant starts in a sitting position and rises to a standing position while gripping a T-bar to perform a squat. One or more elasticized resistance bands stretch through the range of motion. The machine includes pads configured for supporting an individual and restraining him or her throughout the squat motion. The resistance bands, pads and other frame elements are adjustable for repositioning as necessary to optimize the exercise benefit.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Said terminology will include the words specifically mentioned, derivatives thereof and words of similar meaning.

II. Controlled Squat Strength-Training Machine 2

Figure 1:
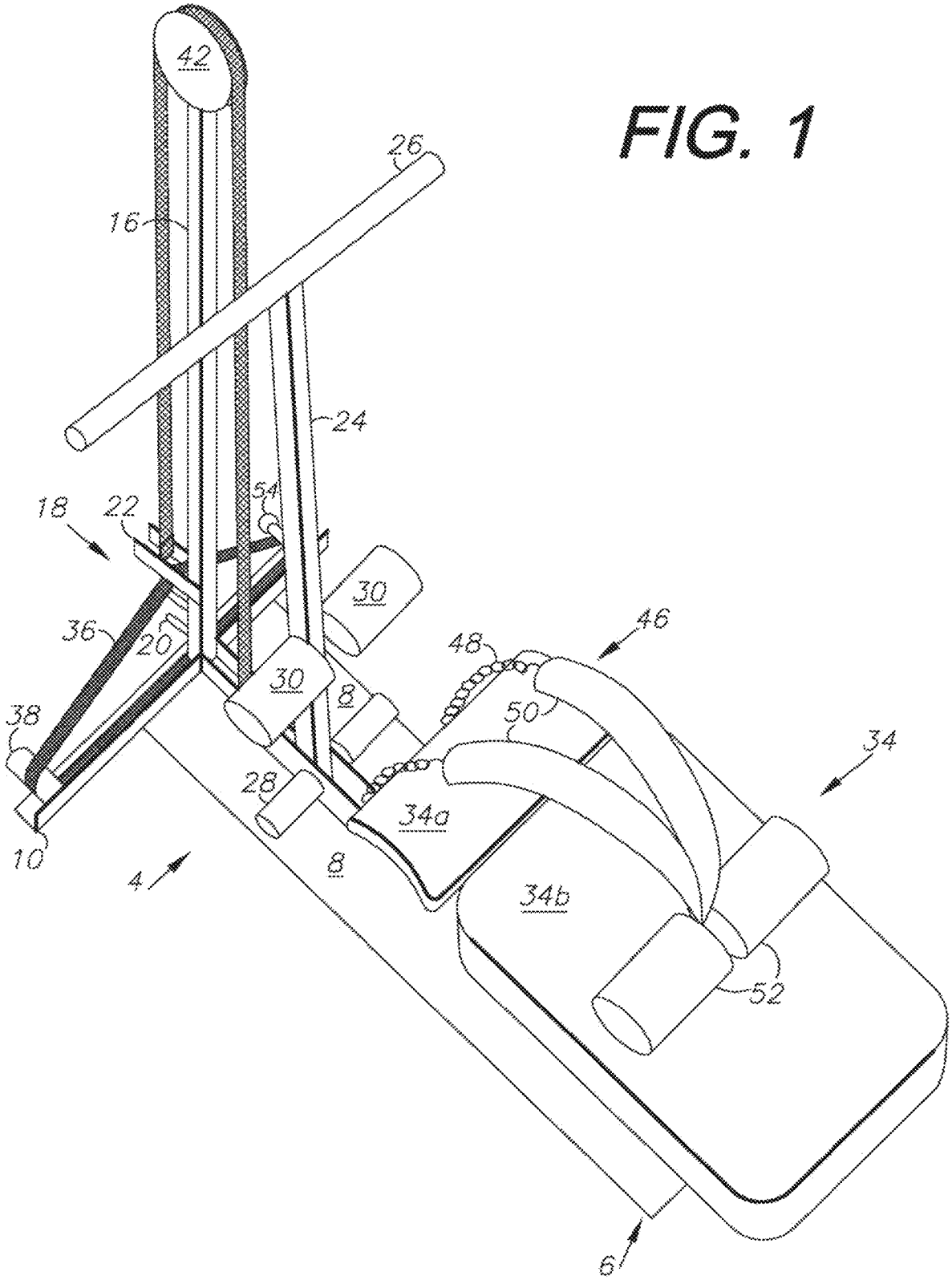
FIG. 1 is a partial, perspective view of a front portion of a controlled squat strength-training machine embodying an aspect or embodiment of the present invention.
Figure 2:
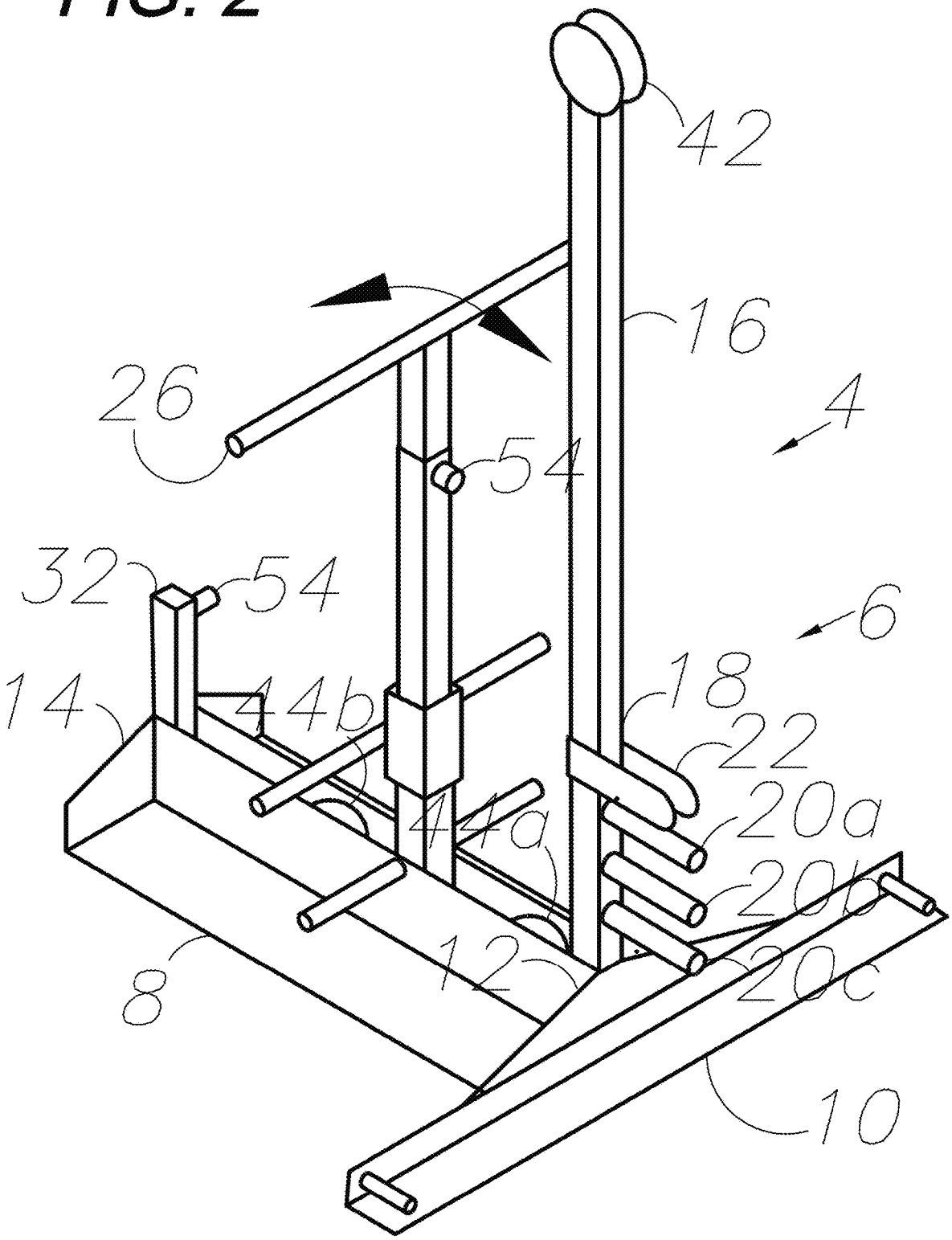
FIG. 2 shows portions of the machine, including: the base frame; the vertical standard with a vertically-sliding traveler, an upper band pulley; a T-bar assembly; and a rear upright for vertically-adjustably mounting a bench.

Referring to the drawings more detail, FIGS. 1-2 show an embodiment or aspect of the present invention comprising a controlled squat strength-training machine, which is generally designated by the reference numeral 2. The machine 2 includes a frame 4 with a base 6, including a pair of longitudinal angle sections 8 and a front, transverse angle section 10. The frame 4 also includes front and back gussets 12, 14.

A front upright 16 is attached to the front gussets 12 and the front ends of the longitudinal angle sections 8. The front upright mounts a traveler 18, which is vertically slidably movable thereon and includes multiple (e.g., 3 are shown) upper, intermediate, and lower rods 20*a*, 20*b*, 20*c* respectively, which extend forwardly from the traveler 18. A pair of forwardly-extending traveler arms 22 are positioned above the rods 20*a*, 20*b* and 20*c*.

An intermediate upright 24 is pivotally connected to the longitudinal angle sections 8 and telescopically, vertically-adjustably mounts a generally horizontal grip bar 26. The intermediate upright 24 also mounts a pair of knee pads or restraints 30.

A pair of padded foot restraints 28 are connected to the longitudinal angle sections 8 and are configured for engagement by a user to facilitate proper foot position and alignment. A rear upright 32 is connected to the longitudinal angle sections 8 and the rear gusset 14. The rear upright 32 adjustably mounts a seat assembly 34 comprising a front, knee-engaging component 34*a* and a rear seat component 34*b*.

An elastomeric resistance band 36 is attached to the transverse angle section 10 by a pair of forwardly-extending resistance band anchors 38. A lifting strap 40 is anchored to the traveler arms 22, passes over an upper pulley 42, passes under front and back lower pulleys 44*a*, 44*b* respectively and terminates at a yoke assembly 46. The yoke assembly 46 includes a chain 48, which mounts a padded yoke 50 configured for placement over a user's shoulders and supporting a pair of pads 52 for placement on a user's neck. The knee pads or restraints 30 engage the user's legs, preferably in proximity to the knees.

The components of the strength-training machine are adjustable to accommodate various users through squat exercises with different ranges-of-motion. For example, telescoping tubes can be secured in place by locking pins 54. Moreover, multiple resistance bands 36, with different resistance characteristics, can be utilized for increasing or decreasing lifting resistance. The resistance band 36 offers greater resistance when placed over the uppermost rod 20*a* and the least resistance when placed over the lowermost rod 20*c*. The yoke assembly connecting chain 48 enables adjustment to accommodate users of different heights.

III. Alternative Embodiments

Figure 3:
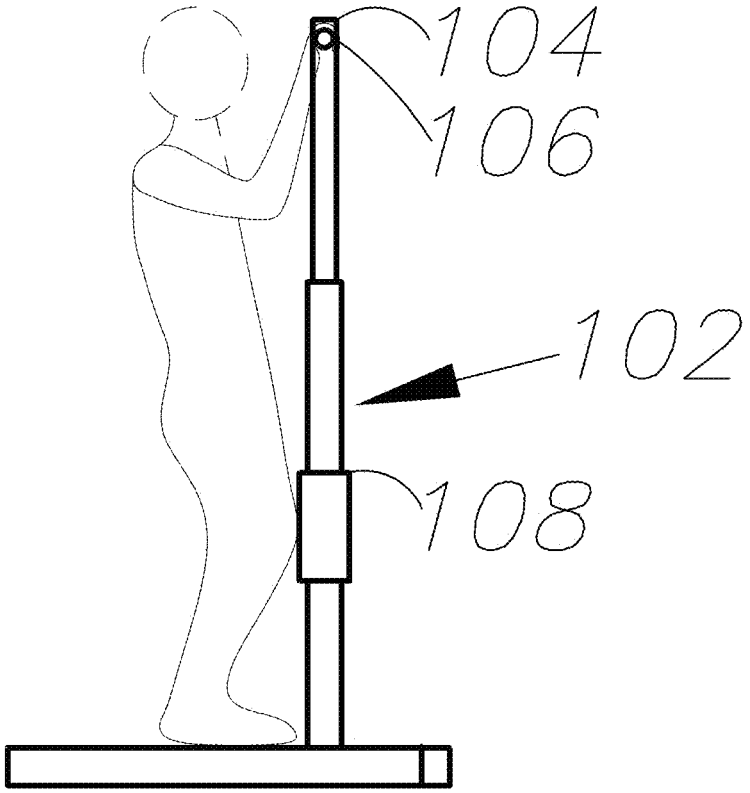
FIG. 3 is a side elevation, showing an alternative embodiment of the present invention with a user in an upright, standing position with his or her knees engaging a knee pad.
Figure 4:
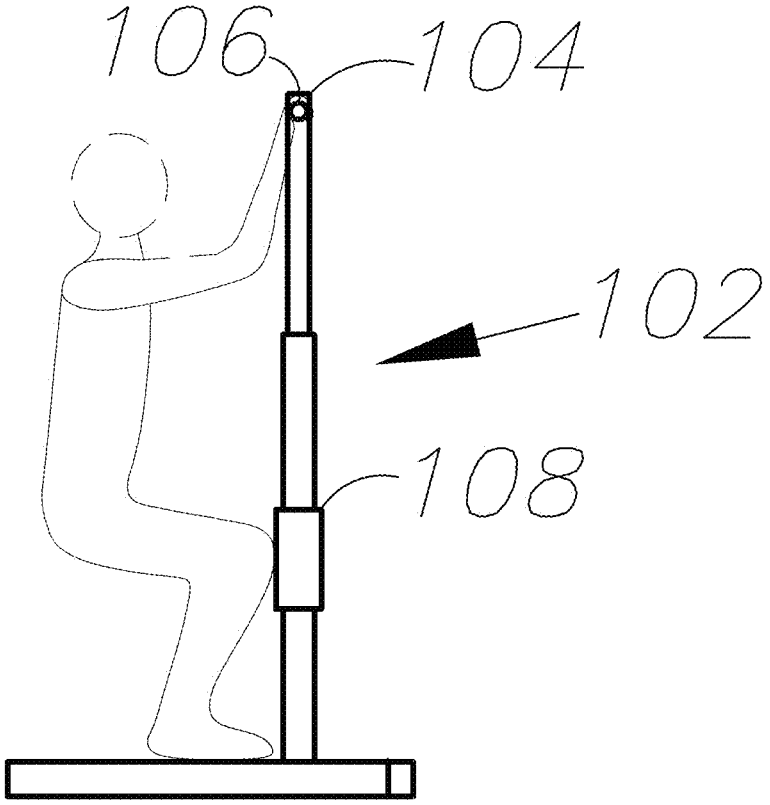
FIG. 4 is another side elevation, showing a user in a squatting position with his or her knees engaging the knee pad.

FIGS. 3-4 show a controlled squat strength-training machine comprising a first alternative aspect or embodiment of the present invention with a modified upright 104, grip bar assembly 106 and knee pad assembly 108. The strength-training machine 102 enables strength-training squats using the bodyweight of the user. The user's body weight can be supplemented with weights, e.g., a weight vest.

Figure 5:
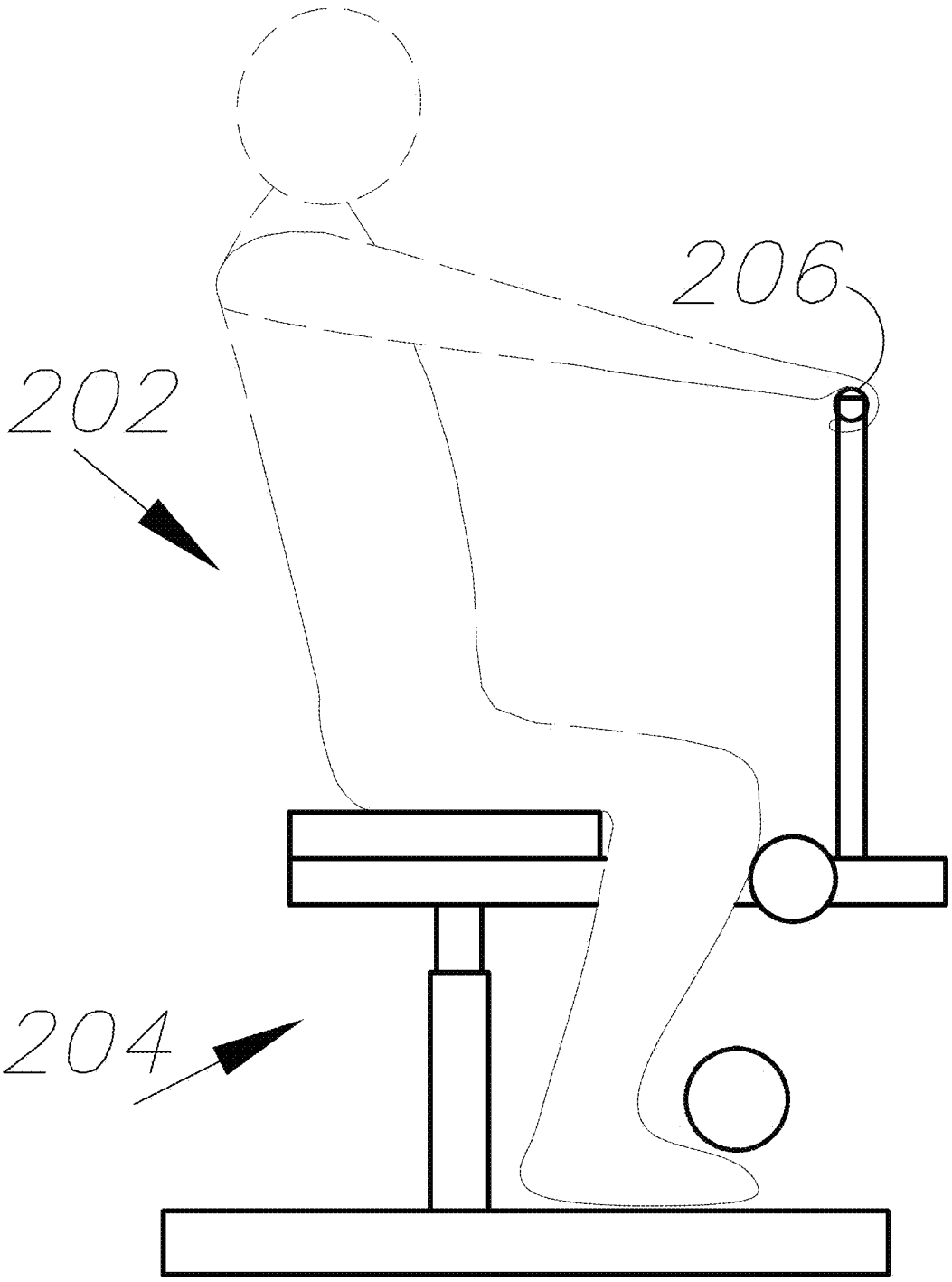
FIG. 5 is a side elevation of another alternative embodiment of the present invention with a user in a seated position.

FIG. 5 shows a controlled squat strength-training machine 202 comprising a second alternative aspect or embodiment of the present invention with a modified seat assembly 204. The user can pull himself or herself up by grasping a grip bar assembly 206.

Figure 6:
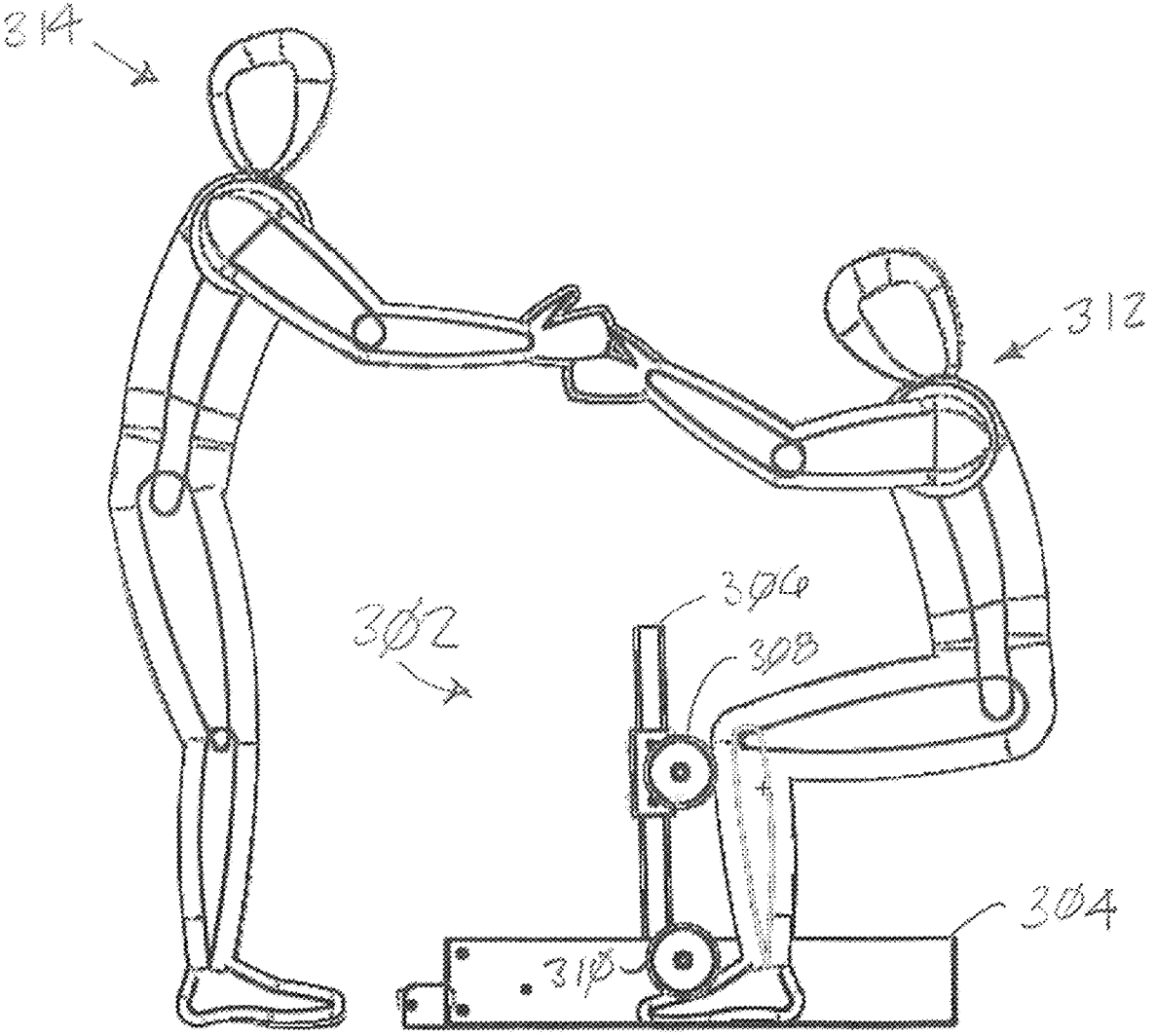
FIG. 6 is a side elevation of another alternative embodiment of the present invention, with a user assisted by a helper. The user is shown in a squatting, start position.
Figure 7:
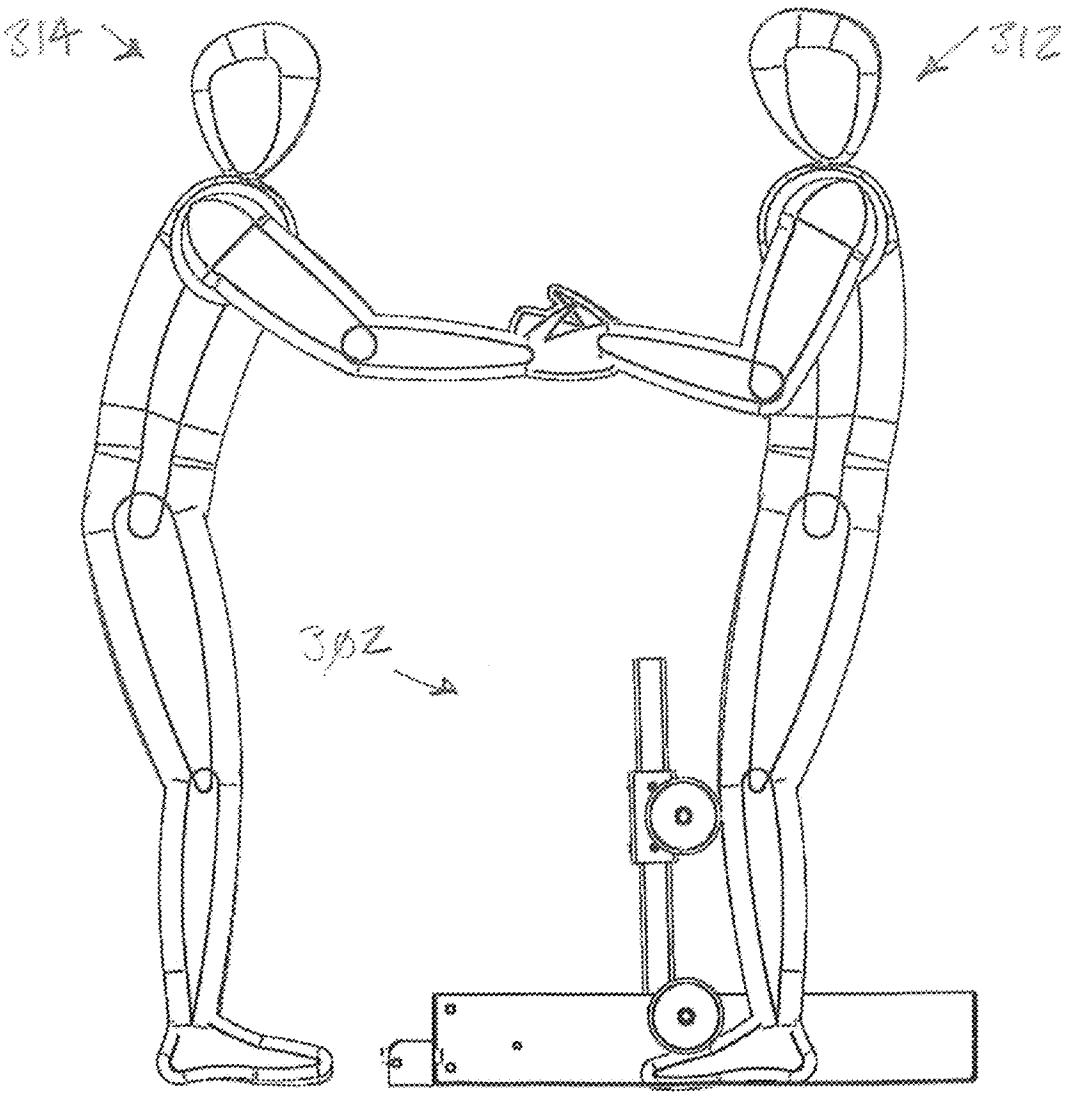
FIG. 7 is a side elevational view thereof, with the user shown in an upright, finish position.

FIG. 6 shows a controlled squat strength-training machine 302 comprising a third alternative aspect or embodiment of the present invention with a base 304 and a rigid upright 306 extending upwardly therefrom and mounting a vertically-adjustable knee pad assembly 308. Foot restraints 310 project laterally from the base 304. A user 312 can properly restrain his or her knees and feet to align the knees throughout the squat exercise. A helper 314 can assist the user 312 in rising to an upright, finish position, as shown in FIG. 7.

Figure 8:
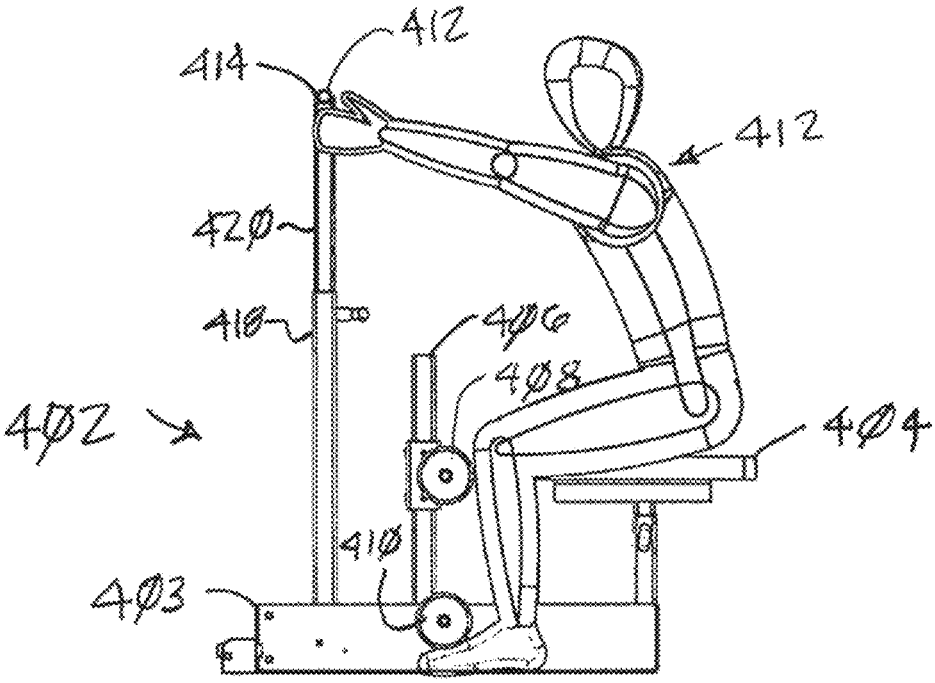
FIG. 8 is a side elevational view of another alternative embodiment of the present invention, with a user shown in a seated, start position.

FIG. 8 shows a controlled squat strength-training machine 402 comprising a fourth modified or alternative embodiment of the present invention with a base 403, seat assembly 404 and an intermediate upright assembly 406 mounting a knee pad assembly 408. A pair of foot restraints 410 project laterally from the base 403. A front upright 412 extends upwardly from the base 403 and mounts a horizontal bar 414 configured for grasping by a user 416. The front upright 402 can comprise outer and inner telescoping tubes 418, 420, which accommodate vertical adjustment to place the horizontal bar 414 at a desired height.

Figure 9:
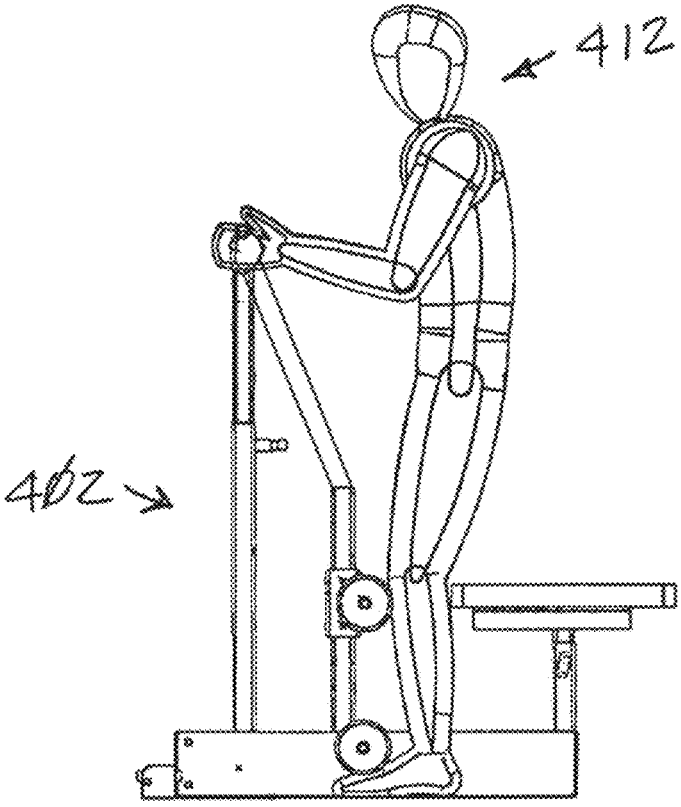
FIG. 9 is a side elevational view thereof, with the user, shown in an upright, finish position.

In operation, the user 416 starts in a seated position on the seat assembly 404 and raises himself or herself to a finish position as shown in FIG. 9. His or her knees are restrained in horizontal alignment by the kneepad assembly 408.

Figure 10:
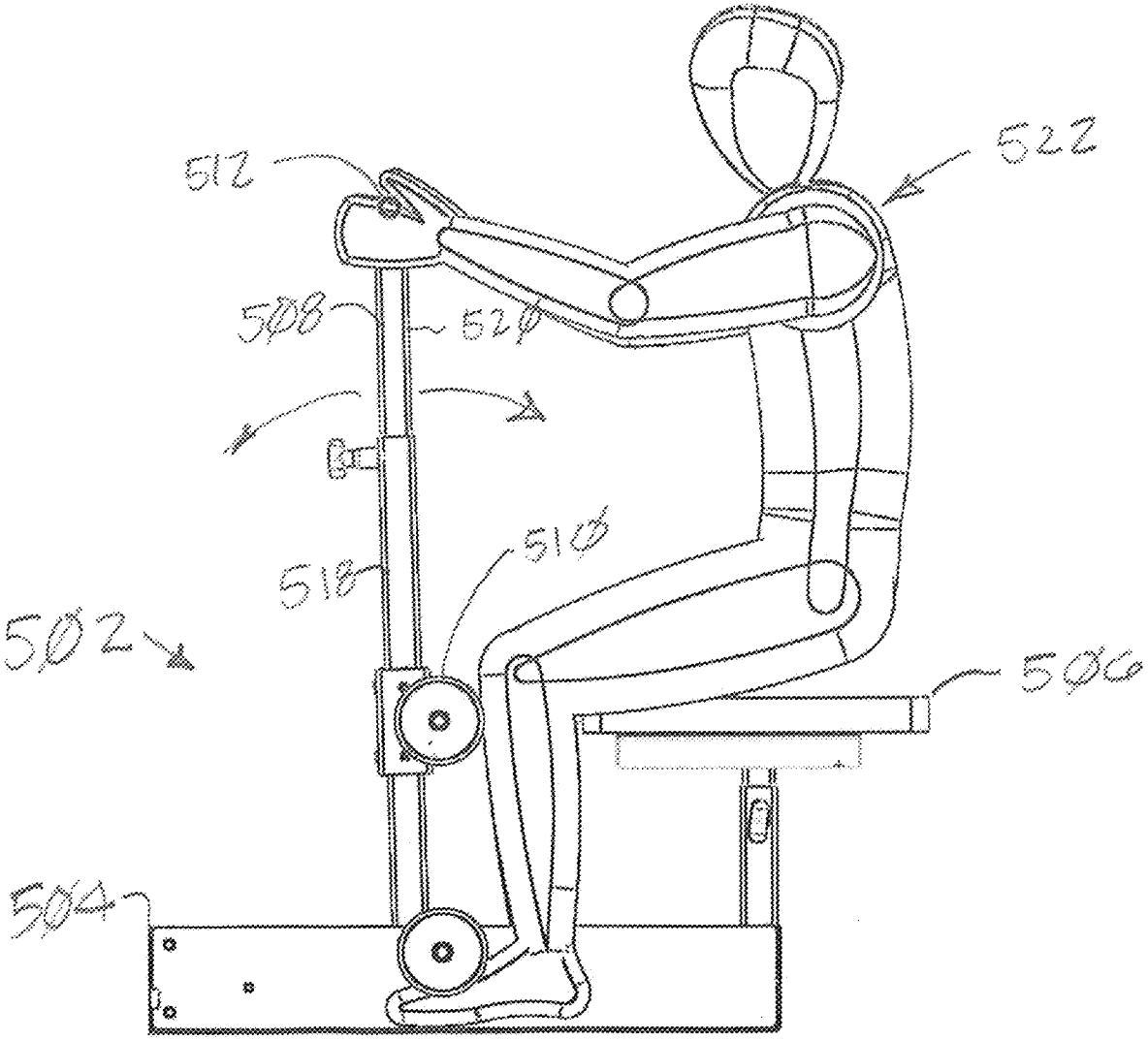
FIG. 10 is a side elevational view of another alternative embodiment of the present invention, with a user shown in a seated, start position.

FIG. 10 shows a controlled squat strength-training machine 502 comprising a fifth modified or alternative embodiment of the present invention with a base level IV mounting a seat assembly 506. A pivoting upright 508 is pivotally attached to the base 504 and mounts a vertically-adjustable kneepad assembly 510. A horizontal bar 512 extends horizontally from the top of the pivoting upright 508. The pivoting upright 508 can comprise outer and inner telescoping tubes 518, 520, which accommodate vertical adjustment to place the horizontal bar 512 at a desired height.

Figure 11:
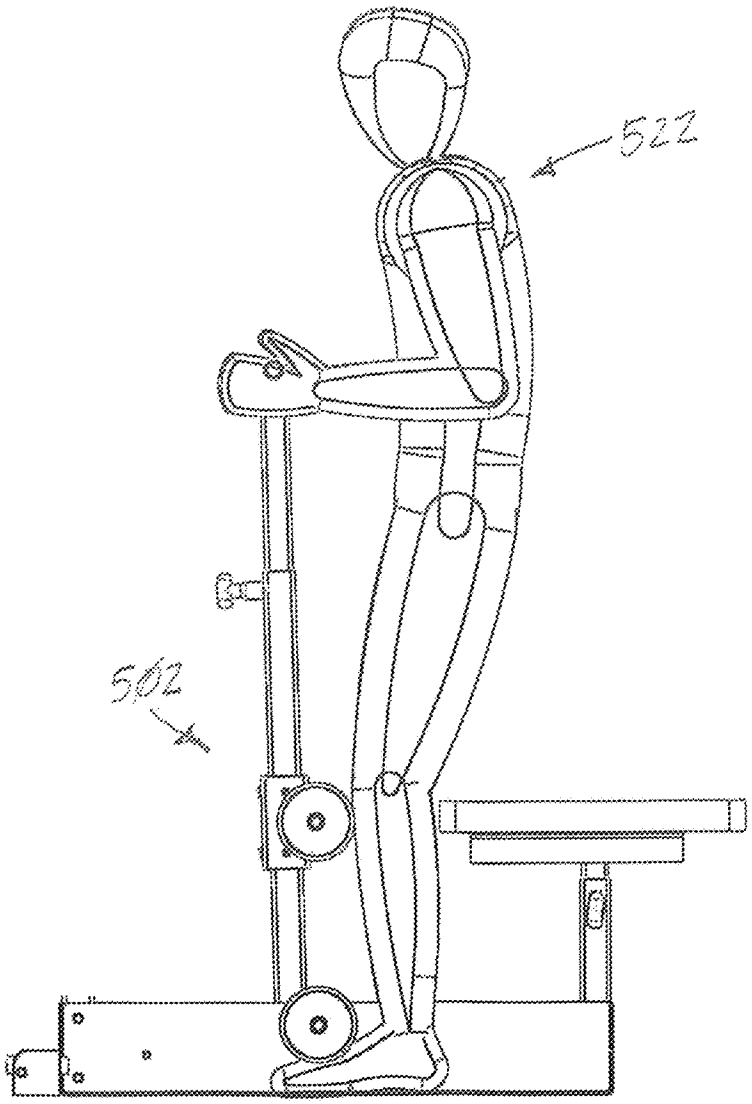
FIG. 11 is a side elevational view thereof, the user shown in an upright, finish position.

In operation, a user 522 starts in a seated position and pulls himself or herself to an upright position as shown in FIG. 11, with the knees maintained in horizontal alignment for maximum benefit from the squat exercise.

IV. Conclusion

It is to be understood that the invention can be embodied in various forms and is not to be limited to the examples specifically discussed above. The range of components and configurations which can be utilized in the practice of the present invention is virtually unlimited.

Having thus described the invention, what is claimed as new and desired to be secured by Letters Patent is:

1. A controlled squat strength-training machine comprising:

a frame including a base configured for placement on a support surface;

an upright with a lower end connected to said base, said upright extending upwardly from said base and terminating at an upright upper end;

said base includes at least one pair of members mounting said upright lower end therebetween;

a knee pad assembly mounted on said upright and configured for engagement by a user's knees;

a seat assembly connected to said base at a back end of said machine;

a front upright including a lower end connected to said base at a front end of said machine and an upper end; and a horizontal bar mounted on said front upright upper end and configured for grasping by a user pulling himself or herself to an upright position from said seat assembly; and said machine configured for restraining a user's knees along a horizontal axis during a squat exercise starting with the user's knees engaging the knee pad assembly, through the standing portion of a squat exercise while his or her knees remain engaged with the knee pad assembly.

2. The strength-training machine according to claim 1, wherein said kneepad assembly includes:

a vertically-adjustable component slidably mounted on the upright and configured for accommodating vertical adjustment of the kneepad assembly.

3. The controlled squat strength-training machine according to claim 1, wherein said knee pad assembly include padded horizontal members configured for engaging a user's knees.

4. The controlled squat strength-training machine according to claim 1, which is configured for placement adjacent to a horizontal support surface for supporting a user in a starting position.

5. The strength-training machine according to claim 2, wherein said at least one pair of members comprises longitudinal extending from front-to-back and mounting said upright lower end therebetween.

6. The strength-training machine according to claim 1, wherein said front upright comprises:

an outer tube, including said lower end mounted on said base;

an inner tube including said upper end and telescopically received in said outer tube; and said front upright is configured for vertical, telescopic adjustment for placing said horizontal bar at a desired height above said base.

7. A controlled squat strength-training machine comprising:

a frame including a base configured for placement on a support surface;

an upright with a lower end pivotally connected to said base, said upright extending upwardly from said base and terminating at an upright upper end;

a horizontal bar mounted on said upright upper end and configured for grasping by a user pulling himself or herself from a squatting, start position to an upright, finish position;

a knee pad assembly mounted on said upright and configured for engagement by a user's knees;

said upright being pivotal about a horizontal axis extending transversely through said base;

said pivotal upright configured for pressing said knee pad assembly against a user's knees continuously through his or her movement from a starting squat position to an upright finish position; and said machine configured for restraining a user's knees along a horizontal axis during a squat exercise starting with the user's knees engaging the knee pad assembly, through the standing portion of a squat exercise while his or her knees remain engaged with the knee pad assembly.

8. The controlled squat strength-training machine according to claim 7, which includes:

a seat assembly fixedly mounted on said base backend and configured for supporting a user in a start, squat position.

9. The controlled squat strength-training machine according to claim 8 wherein said seat assembly is vertically-adjustable.

10. A method of strength-training through a controlled squat, which method comprises the steps of:

providing a frame including a base configured for placement on a support surface;

providing an upright with a lower end pivotally connected to said base, said upright extending upwardly from said base and terminating at an upright upper end;

providing a horizontal bar mounted on said upright upper end and configured for grasping by a user pulling himself or herself from a squatting, start position to an upright, finish position;

providing a knee pad assembly mounted on said upright and configured for engagement by a user's knees;

pivoting said upright about a horizontal axis extending transversely through said base;

pressing said pivotal upright knee pad assembly against a user's knees continuously through his or her movement from a starting squat position to an upright finish position; and restraining a user's knees along a horizontal axis during a squat exercise starting with the user's knees engaging the knee pad assembly, through the standing portion of a squat exercise while his or her knees remain engaged with the knee pad assembly.

11. The method according to claim 10, which includes the additional step of placing said frame adjacent to a support structure.

12. The method according to claim 11, which includes the additional step of said user sitting on said support structure at the beginning of a controlled squat exercise.

13. The method according to claim 12, which includes the additional step of said user maintaining his or her knees in horizontal alignment throughout said controlled squat exercise.

14. The method according to claim 10, which includes the additional step of said user grasping the hands of a helper throughout said controlled squat exercise.

15. The method according to claim 10, which includes the additional step of said user grasping said horizontal bar throughout said control squat exercise.

16. The method according to claim 15, which includes the additional step of vertically adjusting the height of said horizontal bar.

17. The method according to claim 10, which includes the additional step of vertically-adjusting the height of said knee pad assembly.

18. The method according to claim 10, which includes the additional step of providing said upright with telescopically interconnected inner and outer tubes.

19. The method according to claim 18, which includes the additional steps of: vertically adjusting a height of said upright with said telescopically interconnected inner and outer tubes; and fixedly connecting said inner and outer tubes with said upright at a desired elevation.

* * * * *